United States Patent [19]

Lerach et al.

[11] Patent Number: 4,943,251

[45] Date of Patent: Jul. 24, 1990

[54] PEDAL OPERATED OUTBOARD MOTOR FOR WATERCRAFT

[75] Inventors: Thomas E. Lerach, Shoreview, Minn.; Abraham Meron, Hudson, Wis.

[73] Assignee: Yamaha Hatsudoki Kabushiki Kaisha, Japan

[21] Appl. No.: 388,610

[22] Filed: Aug. 2, 1989

[51] Int. Cl.[5] ..... B63H 16/14

[52] U.S. Cl. ..... 440/28; 440/26; 114/347

[58] Field of Search ..... 440/49, 53, 57, 83; 114/343, 347

[56] References Cited

U.S. PATENT DOCUMENTS

| | | | |
|---|---|---|---|
| 1,875,451 | 9/1932 | Harris | 440/28 |
| 2,273,815 | 2/1942 | Bevington | 440/28 |
| 2,627,243 | 2/1953 | Stahmer | 440/28 |
| 2,835,217 | 5/1958 | Newberry | 440/26 |
| 3,211,125 | 10/1965 | Yarbrough | 440/28 |
| 3,244,136 | 4/1966 | Yarbrough | 440/28 |
| 3,377,976 | 4/1968 | Gustine | 440/28 |
| 3,596,624 | 8/1971 | Lay | 440/28 |
| 3,747,555 | 7/1973 | Lay | 440/26 |
| 4,324,551 | 4/1982 | Curries | 440/28 |

*Primary Examiner*—Joseph F. Peters, Jr.
*Assistant Examiner*—Clifford T. Bartz
*Attorney, Agent, or Firm*—Haugen and Nikolai

[57] ABSTRACT

A pedal operated drive system for a canoe includes a main drive assembly in the canoe including a main drive shaft, an intermediate drive shaft extending rearwardly of the main drive shaft to a point beyond the canoe stern, and a propeller shaft behind the canoe, supported pivotally on the intermediate shaft. A lower region of the propeller shaft, below water when the canoe is afloat, supports a propeller. A series of drive rods including a main drive rod, intermediate drive rod and a propeller drive rod, form a driving engagement between the propeller and a pedal and crank assembly on the main drive assembly, for rotating the propeller responsive to rotating the pedal and crank assembly. Each of the drive rods is rotatably contained within its associated shaft. Universal connections between the rods allow them to be positioned at angles with respect to one another, an obtuse angle between the main drive rod and intermediate drive rod being employed to lower the center of gravity of the drive system. A thrust pad is supported at a chosen vertical location along the propeller shaft, but is slidable on the shaft to permit rotation of the propeller shaft to steer the canoe. A forward face of the thrust pad is V-shaped to facilitate a capture of and self-centering engagement with the canoe, for transmitting the thrust of the propeller to the canoe. For optimal efficiency, the thrust pad is positioned along the stern of the canoe near the water level.

18 Claims, 2 Drawing Sheets

PEDAL OPERATED OUTBOARD MOTOR FOR WATERCRAFT

BACKGROUND OF THE INVENTION

This invention relates to apparatus for moving watercraft, and more particularly to an outboard motor and drive linkage suited for propelling canoes.

The numerous and varied apparatus used to power watercraft range from paddles, oars and sails to much more recent developments including gasoline powered outboard motors and electric trolling motors. Today, with increased public awareness and concern over the diminishing supply of fossil fuels and the environmental impact of the combustion of these fuels, there is a renewed interest in means for propelling watercraft by means other than gasoline or electric motors. Such alternative, manual propulsion means afford the advantage of low noise operation, as well as requiring no gasoline, oil, batteries or other auxiliary energy sources.

Manual, pedal operated systems with paddle wheels have been employed for many years. The paddle wheels are rotated through a driving connection with a pedal and crank assembly rotated in much the same manner as a pedal and crank assembly on a typical bicycle. Paddle wheel systems, however, are inefficient and require undue effort for relatively slow motion of the watercraft over short distances.

A relatively recent improvement in pedal operated systems is described in the January 1989 issue of *New Farm* magazine. A pedal propeller drive and seat assembly include rearward clamps for mounting to a boat transom, as well as a forward base and upright standard supporting a pedal and crank assembly with respect to the floor of the boat. This apparatus requires a transom or other transverse, relatively low profile rearward wall for mounting of the device. Thus, the device cannot be mounted in a standard canoe or other watercraft lacking a transom. Due to the relatively high rearward end of the canoe, the apparatus, even if it could be mounted, would operate at an undesirably high center of gravity. The propeller and outboard propeller support are subject to damage from rocks or other obstructions in shallow water.

Therefore, it is an object of the present invention to provide a pedal operated propeller and associated drive assembly particularly well suited for use with standard canoes.

Another object of the invention is to provide a pedal operated drive means removably mountable in canoes of varying sizes and shapes.

Another object of the invention is to provide a pedal operated drive system employing a propeller, including means for protecting the propeller and its support against damage from obstructions below the surface in shallow water.

Yet another object of the invention is to provide a pedal operated watercraft propulsion system including means for efficiently transmitting the thrust of a propeller to the watercraft.

SUMMARY OF THE INVENTION

To achieve these and other objects, there is provided a pedal operated apparatus for propelling watercraft. The apparatus includes a main drive assembly including a main frame means removably fixed to a watercraft, a pedal and crank assembly supported rotatably on the main frame means near its forward end and a main drive means drivably engaged with the pedal and crank assembly and extended along the main frame means to its rearward end portion. A propeller mounting assembly of the apparatus includes an elongate and generally vertical propeller carrying frame member outside of the watercraft and having upper and lower end regions respectively above and below the water level when the watercraft is afloat. A propeller is mounted rotatably relative to the bottom end region, and a propeller drive means, drivably engaged with the propeller, extends along the propeller carrying frame member from the upper end region to the lower end region. An intermediate coupling means supports the propeller assembly and drivably engages the main frame means and the propeller drive means. A force transmitting member is mounted to the propeller carrying frame member medially between the upper and lower end regions. The force transmitting member is positioned to engage the watercraft at a predetermined exterior surface location, to transmit the thrust of the propeller from the propeller carrying frame member to the watercraft at the predetermined location.

Preferably the propeller carrying frame member is spaced apart rearwardly from the watercraft, with the predetermined location along the rearward end of the watercraft approximately at the water level. The main frame means preferably is supported at three points in the watercraft, forwardly on the floor, and rearwardly on opposed gunwales on the watercraft.

The main drive assembly can include an elongate tubular drive shaft generally parallel to the length of the watercraft, and a main drive rod rotatably mounted within the drive shaft. The propeller carrying frame member then includes a tubular propeller shaft and a propeller drive rod rotatably mounted within the propeller shaft. Likewise, the intermediate coupling means includes an elongate tubular intermediate shaft and an intermediate drive rod mounted rotatably within the shaft. Coupling means at the opposite ends of the intermediate rod drivably associate the main drive rod, intermediate rod and propeller drive rod, thus to rotate the propeller responsive to rotation of the pedal and crank assembly. A preferred gear ratio provides for six revolutions of the propeller for each revolution of the pedal and crank assembly.

For steering the watercraft, the propeller shaft pivots on its longitudinal axis, pivoting the propeller as well. In this event the thrust transmitting member, e.g. a thrust pad, is mounted rotatably on the propeller shaft, with a support means independent of the propeller shaft maintaining the thrust pad in a preferred orientation, regardless of propeller shaft pivoting. The propeller shaft and independent support means are preferably supported to pivot about an axis transversely of the propeller shaft axis, to permit accurate travel of the propeller and shaft rearwardly away from the watercraft. Consequently, should the propeller or its supporting structure encounter a rock or other object below the surface in shallow water, the propeller and shaft pivot rearwardly away from the watercraft and remain undamaged.

In connection with canoes, the forward wall of the thrust pad can have a generally V-shaped profile corresponding to the profile of the watercraft near the predetermined location where the watercraft and thrust pad are contiguous. Thus, when pivoted forwardly toward the canoe along with the propeller and propeller shaft, the thrust pad tends to guide and position the propeller shaft in the longitudinal vertical mid-plane of the watercraft. The forward surface of the thrust pad may be lined with a flexible cushioning material if desired, to protect the exterior surface of the watercraft.

The three-point support system for the main frame distributes its weight among the floor and two opposed gunwales of the canoe or other watercraft, whereby even a relatively light and fragile canoe construction may support the propeller drive system. The support requires no transom, and is readily adjustable to correspond to varying spacings between opposed gunwales. The forward support on the floor is by gravity, to facilitate installation and removal of the system. The combination of the main drive shaft, intermediate drive shaft and universal coupling permits an obtuse angle alignment of these shafts, lowering the center of gravity of the system when mounted in a canoe or other watercraft with a relatively high stern. The thrust pad applies the force of the propellers at a point selected for efficiently transmitting the force to the watercraft, yet readily swings away from the watercraft to protect the propeller and propeller carrying structure against damage in shallow water.

IN THE DRAWINGS

For a further understanding of the above and other features and advantages, reference is made to the detailed description of the preferred embodiment and to the drawings, in which.

DETAILED DESCRIPTION OF THE PREFERRED EMBODIMENT

Figure 1:
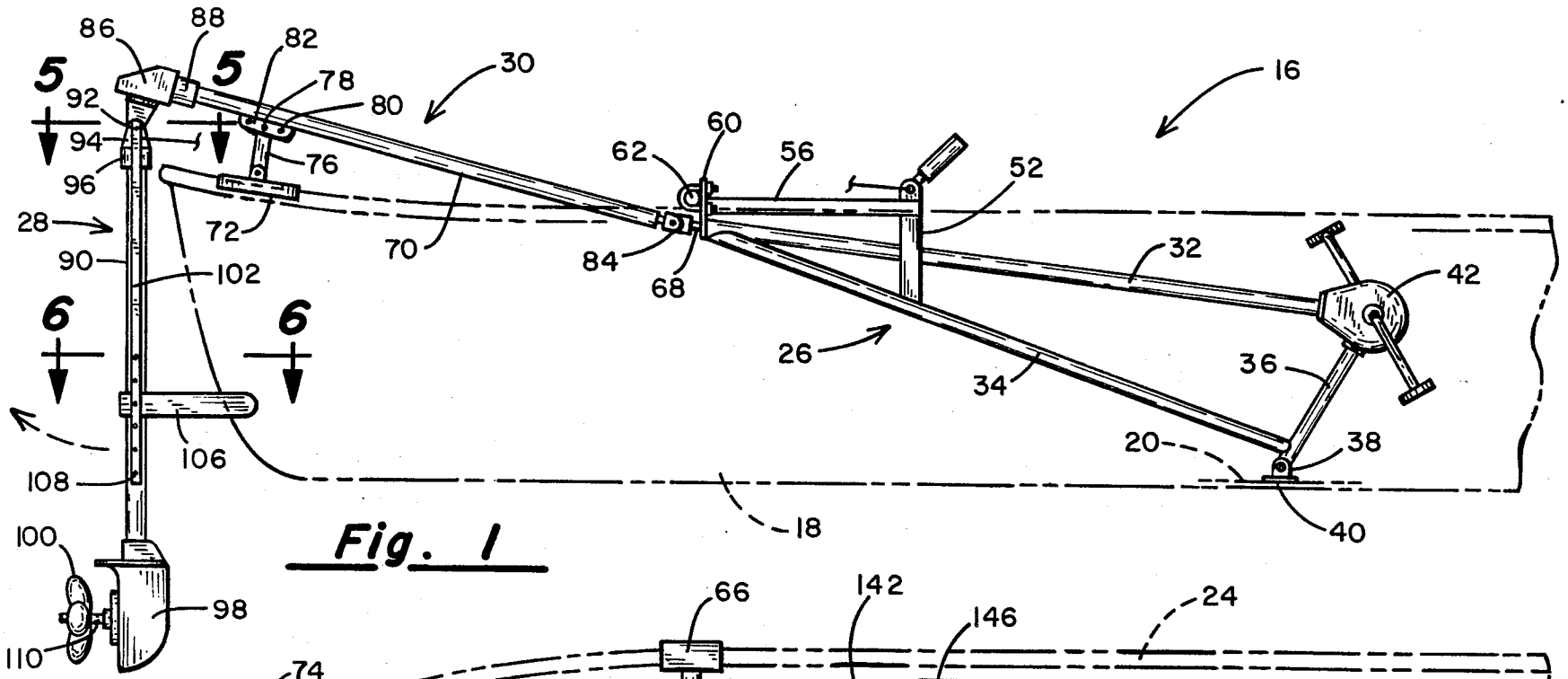
FIG. 1 is a side elevation of a pedal operated watercraft propulsion apparatus constructed in accordance with the present invention.
Figure 2:
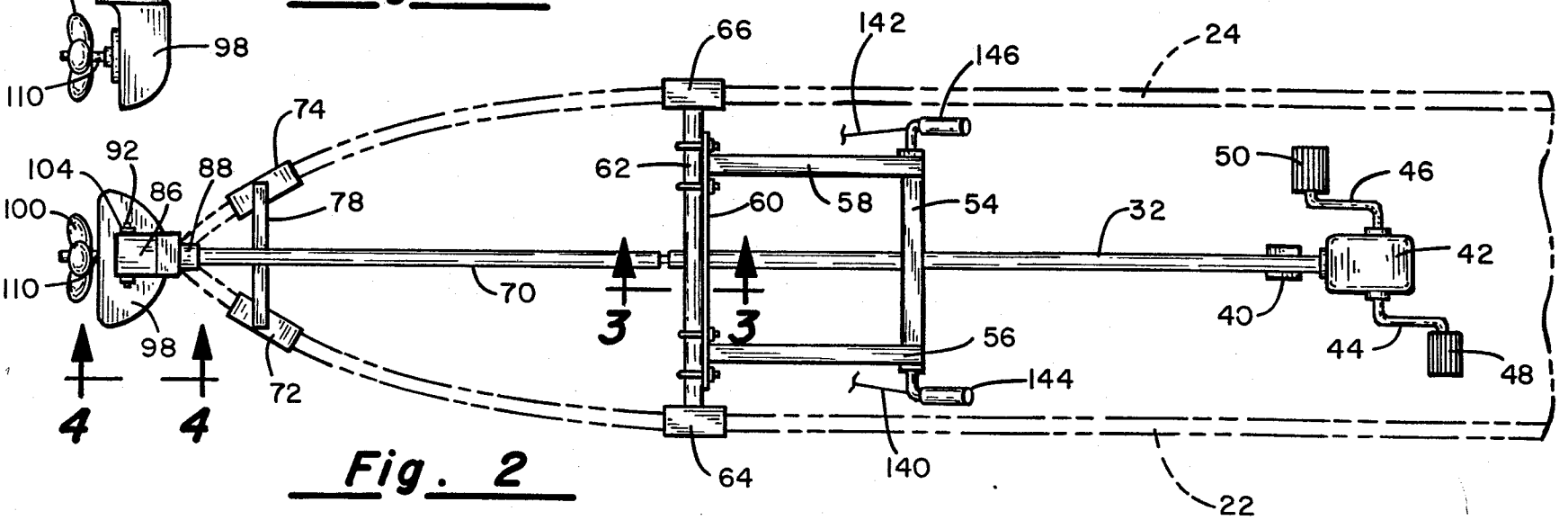
FIG. 2 is a top plan view of the apparatus.

Turning now to the drawings, there is shown in FIGS. 1 and 2 a pedal operated canoe drive system 16 disposed for mounting along the rearward portion of a canoe, illustrated in broken lines at 18. Canoe 18 includes a floor 20, opposed side walls extended upwardly of the floor, and opposed gunwales 22 and 24 forming the top edges of the side walls.

Drive system 16 generally includes three components: a main drive assembly 26, a propeller assembly 28 and an intermediate assembly 30 for coupling the main drive and propeller assemblies. The main drive assembly includes a triangular configuration of elongate, tubular shafts circular in cross-section, preferably metal. These include a main drive shaft 32, a support shaft 34 and a generally upright but forwardly inclined shaft 36.

At its lower end, shaft 36 is pivotally connected to a bracket 38 which in turn is connected to a plate 40 which supports the main drive assembly on floor 20 by gravity. The upper ends of shaft 36 and main drive shaft 32, are connected to a gear enclosure 42 which rotatably supports a pedal and crank assembly including cranks 44 and 46 on opposite sides of the enclosure, and associated pedals 48 and 50.

An upright frame member 52, secured to shafts 32 and 34, supports a seat frame including a transverse forward frame 54, longitudinal side frame members 56 and 58, and a rearward transverse plate 60. The transverse plate is secured to a transversely extended, adjustable length tubular shaft 62, having gunwale clamps 64 and 66 secured to its opposite ends. The transverse shaft is adjustable so that the distance between the clamps can vary to suit canoes of different sizes. The frame members support a seat for the canoe operator, which is not shown, to enhance illustration of various parts of the drive system.

A main drive rod 68 is mounted rotatably within main drive shaft 32 and extends from gear enclosure 42 to a point rearwardly of the main drive shaft. A pair of bevel gears (not shown), including a gear integral with cranks 44 and 46 and another gear integral with main drive rod 68, cause the drive rod to rotate responsive to rotation of the cranks.

Intermediate drive assembly 30 includes an intermediate tubular shaft 70 supported near the stern of canoe 18 by opposed rear gunwale clamps 72 and 74, upright brackets integral with the clamps, one of which is shown at 76 in FIG. 1, and a pin 78 through one of a plurality of apertures 80 in an elongate flange 82 integral with the intermediate shaft. An intermediate drive rod, mounted rotatably within intermediate shaft 70 and extending from one end to the other, is connected to rotate with main drive rod 68 through a universal connection 84. A shroud 86 and collar 88 are fixed to intermediate shaft 70 at its rearward end, and extend rearwardly beyond the stern of canoe 18 for supporting the propeller assembly.

The propeller assembly includes an elongate, substantially vertical tubular propeller shaft 90, the top of which is supported pivotally with respect to shroud 86 through a pin 92 transversely extended through a support 94 with an integral collar 96. Propeller shaft 90 can rotate on its longitudinal or vertical axis with respect to collar 96. A propeller mount 98 and a propeller 100 are supported for rotation along with propeller shaft 90 about the vertical axis. A pair of vertical braces 102 and 104, on opposite sides of propeller shaft 90, support a thrust pad 106 which can rotate with respect to the propeller shaft, thus to maintain a preferred, forward facing orientation of the thrust pad in spite of rotation of the propeller shaft about the vertical axis when steering. Thrust pad 106 further is slidable along propeller shaft 90, to enable vertical adjustment of the thrust pad by securing bolts through any one of a row of openings 108 in brace 104, as well as corresponding, aligned openings in brace member 102. This permits positioning of the thrust pad at about water level when the canoe is afloat, for optimal efficiency in transferring propeller thrust.

Propeller 100 rotates with a horizontal shaft 110, which in turn rotates in response to rotation of a propeller drive rod drivably engaged with horizontal shaft 110 and the intermediate drive rod. The propeller drive rod is rotatably contained within propeller shaft 90.

Figure 3:
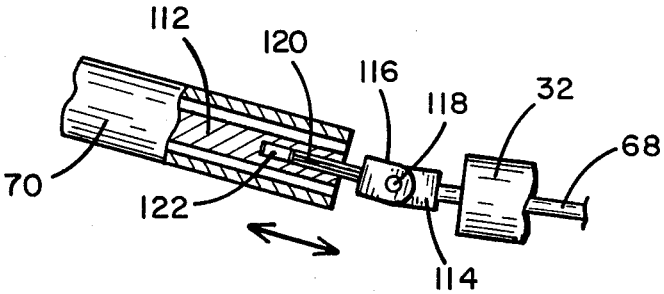
FIG. 3 is a sectional view taken along the line 3—3 in FIG. 2.

As seen in FIG. 3, universal connection 84 between main drive rod 68 and intermediate drive rod 112 includes a link 114 integral with the main drive rod, a link 116 which rotates with the intermediate drive rod, and a transverse pin 118 pivotally connecting links 114 and 116. To facilitate adoption to canoes of various sizes and shapes, link 116 is connected to intermediate rod 112 through a splined shaft 120 integral with the link and slidably supported within a splined opening 122 in the drive rod, so that shaft 120 rotates with the rod but is free to slide with respect thereto. Accordingly, there is a limited variability in the longitudinal separation between drive rods 68 and 112, as well as in the obtuse angle between these members.

The obtuse angle allows drive system 16 to be mounted with a relatively low center of gravity, as compared to a system utilizing a single fore and aft drive shaft. More particularly, canoe 118 has a relatively low stern, and the corresponding obtuse angle between main drive shaft 68 and intermediate drive shaft 112 is nearly 180°, as seen from FIG. 1. However, for canoes with relatively high sterns, the obtuse angle is correspondingly reduced, resulting in a low center of gravity for the drive system.

Figure 4:
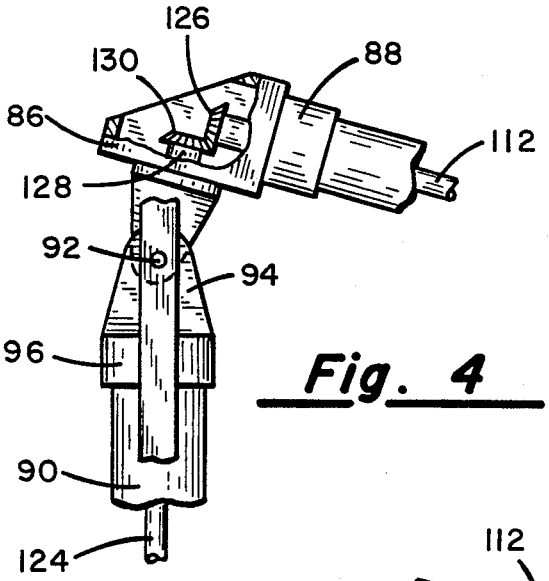
FIG. 4 is a sectional view taken along the line 4—4 in FIG. 2.

FIG. 4 illustrates the drive linkage between intermediate drive rod 112 and propeller drive rod 124. The linkage includes a bevel gear 126 integral with the intermediate rod, a coupling rod 128 and an integral bevel gear 130 engaged with gear 126, and a universal coupling (not illustrated) between coupling rod 128 and propeller drive rod 124, similar to universal coupling 84 between the main drive and intermediate drive rods. A bracket 132, integral with shroud 86, is pivotally coupled to support 94 and collar 96 for supporting propeller shaft 90. As noted above, propeller shaft 90 can pivot relative to collar 96 about the propeller shaft longitudinal axis, which usually is vertical.

Figure 5:
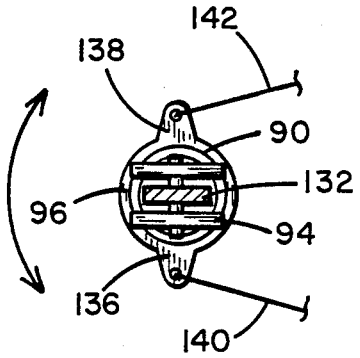
FIG. 5 is a sectional view taken along the line 5—5 in FIG. 1.

FIG. 5 illustrates further details of the propeller assembly support, including pin 92 extended through openings in bracket 132 and parallel sections 134 and 136 of support 94, for permitting collar 96 to pivot about a transverse, horizontal axis with respect to shroud 86. Also illustrated is the manner in which system 16 is used to steer canoe 18. More particularly, opposed ears 136 and 138 extend transversely outwardly on opposite sides of propeller shaft 90, and are integral with the propeller shaft. A cable 140 is secured to ear 136 through an opening in the ear, while a cable 142 similarly is secured to ear 138. Accordingly, a lever 144 (FIG. 2) is operable to pull cable 140 and cause the propeller shaft to rotate clockwise as viewed in FIG. 5. A lever 146, likewise is operable to pull cable 142 and rotate the propeller shaft counterclockwise.

Figure 6:
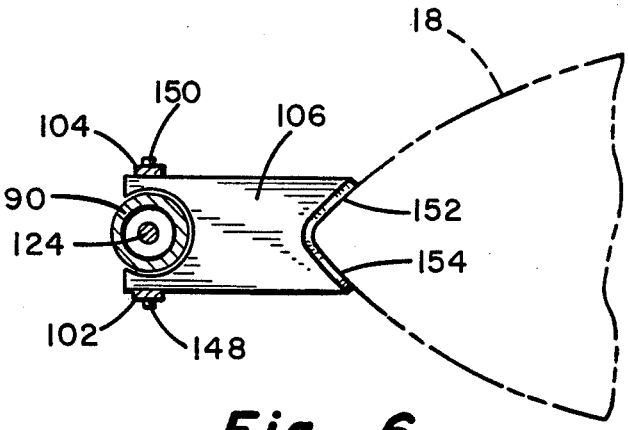
FIG. 6 is a sectional view taken along the line 6—6 in FIG. 1.

From FIG. 6, it is seen that thrust pad 106 is secured to braces 102 and 104 by respective, opposed fasteners 148 and 150. The thrust pad has a rearwardly facing opening corresponding to the horizontal profile of propeller shaft 90, and thus is in a contiguous, wrapping engagement about the shaft. While the vertical position of the thrust pad along shaft 90 is fixed by virtue of the opposed braces and fasteners, which further maintain the thrust pad in a preferred, forward facing orientation as illustrated, shaft 90 is free to rotate relative to the thrust pad to enable steering of the canoe without affecting the thrust pad position.

A forwardly diverging or V-shaped forward face 152 of the thrust pad is of a size and shape to at least generally conform to the V-shaped horizontal profile of the opposed side walls of canoe 18. Thrust pad 106 is preferably a rigid member constructed of fiber reinforced nylon. If desired, a neoprene liner 154 is mounted to the thrust pad along forward face 152 to avoid any injury to the exterior surface of the canoe at the stern.

Accordingly, thrust pad 106 is "secured" to canoe 18 through surface engagement alone, and can travel toward and away from the canoe in an accurate path about the axis of pin 92. This feature is an advantage particularly in shallow water, where propeller mount 98 and propeller 100 are likely to encounter large rocks or other obstructions along the bottom of the lake or stream. A propeller and mount secured rigidly to the canoe would be damaged upon such encounters. By contrast, when forwardly moving canoe 18 carries propeller mount 98 forwardly into an obstruction, continued forward travel of the canoe causes the propeller, mount and propeller shaft 90 to pivot about pin 92, rearwardly relative to the canoe. As seen from FIG. 1, the pivotal motion lifts the propeller and propeller mount relative to the canoe, so that these members can clear the obstruction.

Following clearance, thrust pad 106 must be positioned against canoe 18 once again for further driving of the canoe. This is easily accomplished, simply by operating pedals 48 and 50 to rotate the pedal and crank assembly. The rotating propeller drives the propeller mount, propeller shaft and thrust pad forwardly until the thrust pad engages the canoe once again. The V-shaped profile of the thrust pad forward face facilitates re-engagement, as a relatively wide opening captures the stern, converging rearwardly to center the thrust pad onto the stern (and the vertical midplane of the canoe) as the thrust pad is driven forward.

A 6:1 gear ratio, i.e. a ratio of six revolutions of propeller 100 for each revolution of the pedal and crank assembly, has been found particularly desirable in propelling canoe 18, and is achieved by a 3:1 reduction of the bevel gears in gear enclosure 42, and a 2:1 reduction at the interface of bevel gears 126 and 130. Other suitable ratios can be employed to suit the needs of particular watercraft.

Thus, in accordance with the present invention a canoe drive system is readily adjustably fixed to canoes of various sizes, affords a low center of gravity even for canoes with relatively high sterns, and incorporates a propeller support and drive assembly which pivots away from the canoe to substantially reduce the likelihood of any damage from obstructions in shallow water. The thrust pad on the propeller assembly is self-aligning upon the stern of the canoe, and transmits the propeller thrust at about the level of water when the canoe is afloat, for maximum efficiency in transferring propeller thrust.

What is claimed is:

1. A pedal operated apparatus for propelling watercraft, comprising:

a main drive assembly including a main frame means removably fixed to a watercraft, a pedal and crank assembly supported rotatably on the main frame means near a forward end portion thereof, and a main drive means drivably engaged with said pedal and crank assembly and extended along said main frame means to a rearward end portion of the main frame means;

a propeller mounting assembly including an elongate and generally vertically disposed propeller carrying frame member outside of the watercraft and having upper and lower end regions respectively above and below the water level when the watercraft is afloat, a propeller mounted rotatably relative to said lower end region, and a propeller drive means extended along said propeller carrying frame member from the upper end region to the lower end region and drivably engaged with said propeller;

an intermediate coupling means for supporting said propeller assembly and for drivably engaging said main drive means and said propeller drive means; and a force transmitting member mounted to the propeller carrying frame member medially between said end regions and positioned to engage the watercraft at a predetermined exterior surface location to transmit the thrust of said propeller from the propeller carrying frame member to the watercraft at said predetermined location.

2. The apparatus of claim 1 wherein:

said propeller carrying frame member is spaced apart rearwardly of a rearward end of the watercraft, and said predetermined location is along the rearward end approximately at said water level.

3. The apparatus of claim 2 wherein:

said watercraft includes a floor, a pair of opposed side walls having respective gunwales, and wherein said forward end portion of the main frame means is supported on said floor, and said rearward end portion of the main frame means is supported at said gunwales.

4. The apparatus of claim 2 wherein:

said main drive assembly includes an elongate main drive shaft running generally parallel to the length of said watercraft, and a main drive rod contained in and mounted rotatably with respect to said main drive shaft.

5. The apparatus of claim 4 wherein:

said propeller carrying frame member comprises a tubular propeller shaft, and said propeller drive means comprises an elongate propeller drive rod contained within and rotatable with respect to said tubular propeller shaft.

6. The apparatus of claim 5 wherein:

said intermediate coupling means includes an elongate tubular intermediate drive shaft, an elongate intermediate drive rod contained within and rotatable with respect to said intermediate drive shaft, a first coupling means for connecting said intermediate drive rod to said main drive rod for rotation of said intermediate drive rod responsive to rotation of the main drive rod, and a second coupling means for connecting said propeller drive rod to said intermediate drive rod for rotation responsive to rotation of the intermediate drive rod.

7. The apparatus of claim 6 wherein:

said first and second coupling means comprise first and second universal joints, respectively.

8. The apparatus of claim 5 wherein:

said tubular propeller shaft is pivotable on a longitudinal axis thereof with respect to said watercraft for pivoting said propeller with respect to said watercraft, said force transmitting member is mounted rotatably on said tubular propeller shaft, and said propeller assembly further includes a support means for maintaining said force transmitting member in a selected orientation with respect to the watercraft as said propeller shaft is pivoted.

9. The apparatus of claim 8 further including:

a pair of cables connected to said tubular propeller shaft and operable to pivot said propeller shaft.

10. The apparatus of claim 8 further including:

a means for supporting said propeller assembly rotatably about a pivot axis transversely of said longitudinal axis of the propeller shaft, to permit accurate travel of said propeller assembly rearwardly away from said watercraft.

11. The apparatus of claim 10 wherein:

said side walls converge rearwardly to provide a generally V-shaped profile of said watercraft at said predetermined location, and wherein a forward wall portion of said force transmitting member has a generally V-shaped profile corresponding to said profile of the watercraft, said profile of said force transmitting member facing said watercraft, so as to tend to position said propeller carrying frame member in a longitudinal, vertical mid-plane of said watercraft as said force transmitting member engages the watercraft.

12. The apparatus of claim 11 wherein:

said force transmitting member is constructed of a flexible cushioning material at least along said V-shaped profile.

13. An apparatus for supporting a propeller with respect to a canoe and operable to propel the canoe, including:

an elongate generally vertical propeller carrying frame member disposed outside of a canoe and having upper and lower end regions respectively above and below the water level when the canoe is afloat, a propeller mounted rotatably relative to the lower end region, and a propeller drive means extended along the propeller carrying frame member from the upper end region to the lower end region and drivably engaged with the propeller, and means for supporting the elongate propeller carrying frame member generally vertically, with respect to and outside of the canoe;

a main drive assembly including a main frame means fixed to the canoe and a main drive means movable relative to the main frame means, an intermediate coupling means for supporting the propeller carrying frame member with respect to the canoe and for drivably engaging said main drive means and propeller drive means;

wherein said canoe includes a floor, and opposite side walls each having a gunwale, said side walls converging rearwardly to a stern of the canoe, said propeller carrying frame member being supported rearwardly of said stern; and a force transmitting member mounted to the propeller carrying frame member medially between the upper and lower end regions and positioned to engage the rearward end of the canoe along a predetermined exterior location, to transmit the thrust of said propeller from the propeller carrying frame member to the canoe at said predetermined location, said force transmitting member having a forward surface portion with a generally V-shaped profile corresponding to a similar profile of the canoe at said predetermined location, said force transmitting member being mounted with respect to said propeller carrying frame member such that surface engagement of said forward surface portion and canoe at said predetermined location tends to align said propeller carrying member in a vertical longitudinal mid-plane of said canoe.

14. The apparatus of claim 13 wherein:

said propeller carrying frame member is pivotable relative to said canoe about a longitudinal axis of the propeller carrying frame member, thereby to rotate said propeller, wherein said force transmitting member is mounted rotatably on the propeller carrying frame member, and wherein the propeller carrying frame member further includes a means for supporting the force transmitting member with said forward surface portion facing said canoe independently of rotation of the propeller carrying frame member.

15. The apparatus of claim 14 further including:

a means for supporting said propeller carrying frame member pivotally about an axis transversely of the canoe, thereby allowing said propeller shaft, propeller and force transmitting member to move generally rearwardly away from the canoe in an accurate path.

16. A pedal operated drive apparatus for a canoe, comprising:

a main drive assembly including a main frame means removably fixed to a canoe having a floor and two opposite side walls converging from a medial region of the canoe toward forward and rearward ends of the canoe, each side wall having a gunwale;

said main drive assembly including a main frame means having a forward end portion supported on said floor and a rearward end portion supported on said gunwales, said main drive assembly further including a pedal and crank assembly supported rotatably on the main frame means near said forward end portion, and a main drive means drivably engaged with the pedal and crank assembly and extended along said main frame means to the rearward end portion;

a propeller mounting assembly including an elongate generally vertical propeller carrying frame member having upper and lower end regions respectively above and below the water level when the canoe is afloat, a propeller mounted rotatably relative to the lower end region, and a propeller drive means extended along the propeller carrying frame member from the upper end region to the lower end region and drivably engaged with the propeller; and an intermediate coupling means for supporting the propeller mounting assembly rearwardly of and outside of said canoe, and for drivably engaging said main drive means and said propeller drive means.

17. The apparatus of claim 16 wherein:

said main frame means comprises a tubular main drive shaft extended generally longitudinally of the canoe, and said main drive means includes a main drive rod supported within and rotatable with respect to the main drive shaft.

18. The apparatus of claim 17 wherein:

said intermediate coupling means comprises a tubular intermediate drive shaft and further includes an intermediate drive rod contained within and rotatable with respect to said intermediate drive shaft, a first coupling means for connecting the intermediate drive rod to the main drive rod for rotation therewith, and a second coupling means for connecting the propeller drive means to said intermediate drive rod for rotation therewith.

* * * * *

UNITED STATES PATENT AND TRADEMARK OFFICE

CERTIFICATE OF CORRECTION

PATENT NO. : 4,943,251

DATED : July 24, 1990

INVENTOR(S) : Thomas E. Lerach and Abraham Meron

It is certified that error appears in the above-identified patent and that said Letters Patent is hereby corrected as shown below:

Column 7, line 68 "accurate" should read -- arcuate --.

Column 9, lines 13 and 14 "accurate" should read --arcuate --.

Signed and Sealed this

Twenty-ninth Day of October, 1991

*Attest:*

HARRY F. MANBECK, JR.

*Attesting Officer*

*Commissioner of Patents and Trademarks*